United States Patent [19]

Huiber

[11] Patent Number: 4,536,134

[45] Date of Patent: Aug. 20, 1985

[54] PISTON SEAL ACCESS APPARATUS

[75] Inventor: Otto A. Huiber, Kentwood, Mich.

[73] Assignee: Hi-Tech Engineering, Inc., Grand Rapids, Mich.

[21] Appl. No.: 605,204

[22] Filed: Apr. 30, 1984

[51] Int. Cl.[3] ..... F04B 9/10

[52] U.S. Cl. ..... 417/360; 417/403

[58] Field of Search ..... 417/360, 401, 403

[56] References Cited

U.S. PATENT DOCUMENTS

| | | | |
|---|---|---|---|
| 952,853 | 3/1910 | Webb et al. | 417/403 X |
| 1,469,267 | 10/1923 | Rembold . | |
| 1,977,075 | 10/1934 | Magnuson . | |
| 2,435,330 | 2/1948 | Steiner . | |
| 3,967,542 | 7/1976 | Hall et al. . | |
| 4,161,308 | 7/1979 | Bell et al. | 417/403 X |
| 4,272,224 | 6/1981 | Kabele | 417/360 |

*Primary Examiner*—Leonard E. Smith

*Attorney, Agent, or Firm*—Price, Heneveld, Huizenga & Cooper

[57] ABSTRACT

A chemical pump includes an access sleeve positioned between a hydraulic driving cylinder and the chemical injection cylinder with a rod coupled between the hydraulic driving piston and the injection piston. The access sleeve structurally secures the driving cylinder to the injection cylinder and includes access ports through a sidewall thereof such that when the injection piston is withdrawn into the sleeve, the seals are accessible for replacement or other piston maintenance. According to another aspect of the invention, the diameter of the hydraulic piston is substantially greater than that of the injection piston.

8 Claims, 3 Drawing Figures

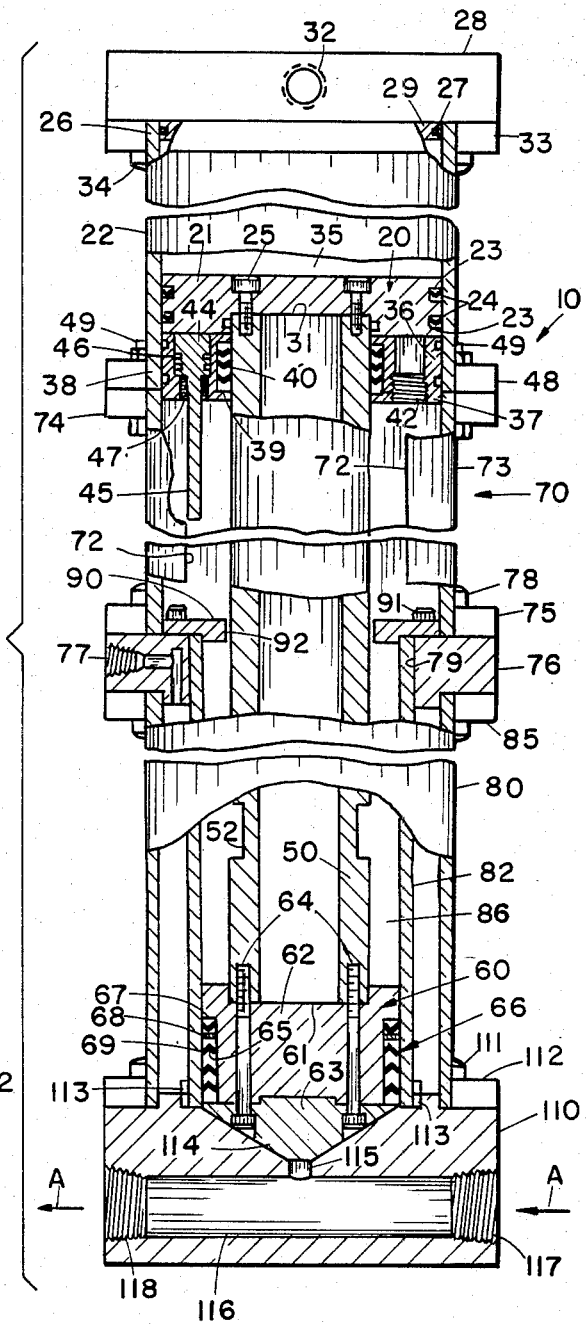
FIG 1
FIG 2
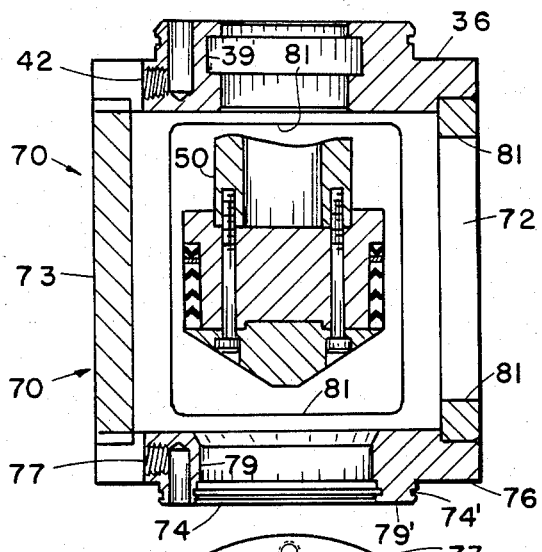
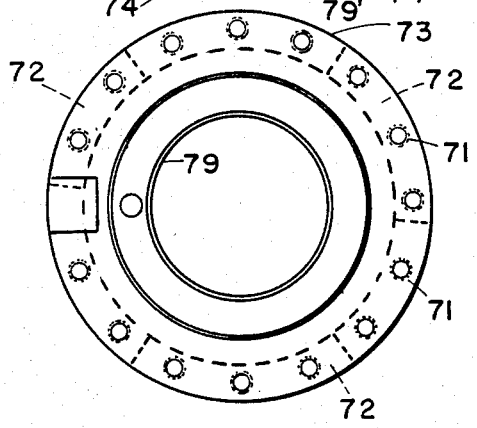
FIG 3

PISTON SEAL ACCESS APPARATUS

BACKGROUND OF THE INVENTION

The present invention pertains to a piston injection pump, and particularly, to means for gaining access for replacement of piston seals therein.

Injection molding apparatus for use in, for example molding polyurethane products, include reservoirs of component liquid materials supplied to an injection cylinder for the high pressure injection of such chemicals into a mixing head for subsequent injection into a mold for making articles. In such systems, the piston assembly for injecting the liquid into the mixing head develops pressures in the range of 2,000 to 3,000 pounds and is hydraulically driven. When it is necessary to replace the seals of the high pressure injection piston, typically, it has been necessary to disassemble the piston cylinder for removal of the piston head such that the seals can be replaced. With the prior art systems, the injection piston, typically, must be withdrawn through an access opening at one end which exposes it to the hydraulic fluid as well as depositing corrosive chemicals within the hydraulic cylinder. As a result, both cylinders and the piston need to be carefully cleaned which even requires additional time for seal replacement. Frequently, this required up to a day which naturally rendered the injection apparatus inoperative preventing use of up to several mixing heads in a given facility.

Further, typically the diameter of the hydraulic and injection pistons are identical. Since the amount of chemicals metered out by the pump is the same as the hydraulic fluid used to move the hydraulic piston and is at the same pressure, precise hydraulic pump fittings are required to assure accurate chemicals pumping.

SUMMARY OF THE INVENTION

The system of the present invention provides an access sleeve positioned between the hydraulic driving cylinder and the chemical injection cylinder with a rod coupled between the hydraulic driving piston and the injection piston. The stroke of the driving piston is sufficient to withdraw the injection piston from the injection cylinder into the access sleeve. The access sleeve structurally secures the driving cylinder to the injection cylinder and includes access ports through a sidewall thereof such that when the injection piston is withdrawn into the sleeve, the seals are accessible for replacement or other piston maintenance. In one embodiment of the invention, removable stop means are provided such that the injection piston can be withdrawn from the injection cylinder only once the stop means are removed.

With such a system, rapid and easy replacement of the high pressure injection system seals can be accomplished in relatively brief time requiring only a few minutes as opposed to the necessity to completely tear down the injection cylinder which also frequently required cleaning of the entire chemical system. Inasmuch as the piston is withdrawn from the cylinder only briefly, typically, the injection cylinder need not be cleaned.

According to another aspect of the invention, the diameter of the hydraulic piston is substantially greater than that of the injection piston. As a result, lower pressure hydraulic fittings can be employed and the hydraulic fluid volume accuracy need not be as great for the same chemical liquid injection accuracy.

Thus, the system of the present invention provides a vastly improved apparatus for use in connection with liquid pumping cylinders. These and other features, objects and advantages of the present invention will become apparent upon reading the following description thereof together with reference to the accompanying drawings in which:

BRIEF DESCRIPTION OF THE DRAWINGS

FIG. 1 is a vertical, cross-sectional view, partly broken away and partly in fragmentary form, of an injection pump embodying the present invention;

FIG. 2 is a somewhat enlarged, vertical, cross-sectional view of an alternative access sleeve embodying the present invention; and FIG. 3 is a bottom view of the structure shown in FIG. 2.

DETAILED DESCRIPTION OF THE PREFERRED EMBODIMENT

Referring initially to FIG. 1, there is shown a fluid pump 10 which includes a hydraulic driving piston assembly 20 and a liquid chemical pumping piston assembly 60 with assemblies 20 and 60 commonly coupled by a cylindrical piston rod 50. An injection piston access port sleeve assembly 70 is positioned intermediate and couples the hydraulic piston cylinder 22 and the injection cylinder 82. As will be described in detail hereinafter, piston assembly 60 can be withdrawn into the area of sleeve 70 which includes a plurality of access ports 72 formed therein permitting servicing of the piston, as illustrated in FIG. 2. Having briefly described the overall system components and their respective arrangement, a detailed description of the structure is now presented.

The piston assembly 20 includes a cylindrical disc-shaped piston head 21 with a pair of spaced annular apertures 23 for receiving annular seals 24 therein. The piston head is secured to the rod 50 by means of a plurality of cap screws 25 threaded within one end 31 of piston rod 50. The upper end 26 of the driving cylinder 22 is enclosed by a cap 28 having a disc-shaped extension 29 sealingly engaging the inner walls of cylinder 22 by an O-ring seal 27. A mounting ring 33 is welded to end 26 of cylinder 22, and cap 28 is secured, as shown, by a plurality of fastening bolts 34 extending into the threaded end of cap 28 through ring 33. Cap 28 includes a hydraulic passageway 32 which communicates with the internal cylindrical space 35 above piston head 21 and between it and cap 28. The length of cylinder 22 is somewhat greater than the length of injection cylinder 82 such that the stroke of piston rod 50 is sufficient to allow piston 60 to be withdrawn entirely from the open upper end of cylinder 82 into the sleeve 70 and centered therein, as illustrated in FIG. 2.

The end of hydraulic cylinder 22 opposite cap 28 is enclosed by a plate 36 defining a sealing plug having a flange 37 engaging an end 38 of cylinder 22 opposite the cap end. Plate 36 includes an internal annular groove 39 for receiving a compound piston rod seal 40 which allows piston rod 50 to sealably slide in a vertical direction within plate 36. A threaded passageway 42 is coupled to a source of hydraulic pressure through conventional hydraulic lines and fittings to urge piston 20 in a retracted or raised position, as illustrated in FIG. 1. The plate 36 also includes a limit switch 44 mounted in an aperture and extending axially therethrough and including a sensing element 45 extending within access sleeve 70 for sensing the raised position of piston rod 50. Limit switch 44 is sealably secured within an aperture formed through plate 36 by suitable O-ring seals 46 and is locked into place by a snap-ring 47. The lower end of cylinder 22 also includes a ring 48 welded thereto for bolting the cylinder to sleeve assembly 70 by means of fastening bolts 49 spaced around the periphery of the cylindrical ring. The flange 37 of plate 36 secures the plug in a fixed position sealing the lower end of the hydraulic driving cylinder.

Sleeve assembly 70 includes a ring 74 welded to one end of the cylindrical sleeve 73 and including apertures spaced around the periphery thereof for securing section 70 to the hydraulic driving piston assembly 20. Sleeve assembly 70, as also seen in the alternate embodiment of FIGS. 2 and 3, which carry identical reference numbers on corresponding structural elements, includes a sleeve 73 with three 60° arcuate, generally rectangular openings 72 extending through the sidewalls of the otherwise continuous cylindrical sleeve to define arcuate ports permitting access to the injection piston head assembly when withdrawn within the axial space of cylindrical sleeve 73. A mounting ring 75 (FIG. 1) is welded to the lower cylindrical end of cylindrical sleeve 73 for securing it to the lower injection cylinder water jacket 80 by means of a coupling plate 76. In the FIGS. 2 and 3 embodiments, the diameter of sleeve 73 is larger than that of the sleeve shown in FIG. 1 such that the opposite ends each include threaded apertures 71 for receiving fastening bolts 49 and 78 directly.

The coupling plate 76 includes a threaded water intake 77 defining a passageway to which a source of pressurized water can be supplied to a cooling water jacket defined by the outer concentric space between the outer surface of injection cylinder 82 and the inner surface of cylinder 80. Plate 76 is sandwiched between the ring 75 secured to sleeve 73 and a similar ring 85 welded to the upper end of cylindrical jacket 80 with the two being secured by a plurality of spaced bolts 78 extending around the periphery of the two rings 75 and 85 and through suitable aligned apertures in plate 76.

Plate 76 also includes an inner cylindrical opening 79 for sealably receiving the outer cylindrical surface of the injection cylinder 82. In FIG. 1, tube 82 is welded within aperture 79, while in the FIGS. 2 and 3 embodiments, an annular O-ring seal is fitted within an internal groove 74 of aperture 79. A groove 74' (FIG. 2) on the outside of flange 79' seals sleeve 73 to the inside of water jacket sleeve 80 in the alternative embodiment.

In both embodiments, an annular stop plate 90 is removably secured to the lower inside portion of sleeve 73, preferably on the top of plate 76. Stop 90 includes a circular opening 92 extending therethrough for permitting the piston rod 50 to freely pass therethrough and yet engage the piston head 60 once raised to the uppermost end of injection cylinder 82. Stop plate or ring 90 is secured by a plurality of cap screws 91 extending through apertures in ring 90 and threaded within plate 76. The cap screws are sufficiently near the edges 81 of slots 72 formed in the access sleeve 73 so as to permit loosening of the stop ring 90 easily through such apertures 72. The stop ring will then ride on rod 50 against piston 60 as the piston is withdrawn into sleeve 73 for replacement of the injection piston seals.

The lower end of cylinder 80 is secured to an inlet block 110 by means of a ring 112 welded to the lower end of the water jacket cylinder 80 and secured to block 110 by means of a plurality of bolts 111. Similarly, the injection cylinder 82 is secured to the block 110 and sealed thereto by means of O-ring seals 113 extending around the outer surface of cylinder 82 and within an annular slot formed in block 110 for receiving the end of cylinder 82. Block 110 also includes a generally conical piston head receiving recess 114 and having a passageway 115 communicating with the end thereof into a liquid injection passageway 116 having a threaded inlet 117 at one end. Inlet 117 is coupled to a supply of liquid to be injected through a check valve permitting fluid motion in a direction only indicated by arrow A. An outlet 118 is formed at an end of passageway 116 opposite inlet 117 for coupling to a check valve between the pump 10 and a mixing head of the system allowing fluid to flow only in a direction indicated by arrow A adjacent outlet 118.

Coupled to the lower end of piston rod 50 is the injection piston head assembly 60 including a piston head 62 of generally cylindrical configuration and having a circular depression 61 for receiving the end of piston rod 50. A cap 63 is sealably secured to piston head 62 and to piston rod 50 by means of a plurality of countersunk cap screws 64. Head 62 also includes an annular groove 65 formed at its lower end thereof for receiving a complex piston seal assembly 66 including an upper seal 67 facing in a first direction, a spacer 68, and a plurality of lower seals 69 facing in a direction opposite seal 67 and resisting flow of fluid upwardly past piston head 62. The diameter of conical cap 63 for piston head assembly 60 is such that the seals 67 and 69 are held in position thereby; typically, however, seals 67 and 69 can be removed for replacement without removing cap 63 simply by slipping the seals off from the end of the piston head.

In operation, the double acting hydraulic driving cylinder 20 is supplied with hydraulic pressure in the range of 1,000 to 1,500 psi. The diameter of piston 21 is approximately twice that of the injection cylinder piston 60 such that the outlet pressure of the chemical being pumped is approximately twice that of the hydraulic driving pressure applied within cylinder space 35. The cylinder is retracted by application of hydraulic pressure through port 42 which raises piston 60 drawing chemical through inlet 117, passageways 116 and 115 into the injection chamber 86. The hydraulic fluid pressure is applied until the piston rod is withdrawn within cylinder 82 a predetermined amount with a limit switch (not shown) being actuated by notch 52 formed in the piston rod for providing a control signal to the conventional control system indicating that the piston head is within cylinder 82 but near its travel limit. Hydraulic pressure is then applied to the hydraulic driving cylinder through port 32 for injecting the chemical outwardly through aperture 118 with the check valves permitting movement of the chemical only in the direction indicated by arrows A.

When replacement of the seal assembly 66 is required, the cap screws 91 are removed allowing stop ring 90 to move freely along piston rod 50 and hydraulic piston 20 actuated to fully withdraw piston 60 from cylinder 82 into the sleeve assembly 70 for access. The limit switch 44 engages the top of piston head 62 providing a control signal limiting the upward motion of piston rod 50 and centering piston head 62 within sleeve 73 centered between the edges 71 of the apertures 72 formed in sleeve 73. With the piston head in a position shown in FIG. 2, the three equally spaced 60° arcuate slots 72 permit free access for removal of seals 67 and 69 and, if necessary, for removal or replacement of piston head 62 and/or cap 63. The sleeve 73 naturally includes three 60° arcuate sidewalls between the access ports 72 providing sufficient strength for mechanically coupling the hydraulic driving cylinder 22 to the injection cylinder 82 through sleeve 80 and plates 36 and 76.

By employing a hydraulic driving piston 20 having a diameter approximately twice that of injection piston head 62, approximately ½ the normal hydraulic pressure need be used in connection with such equipment which allows the use of standard hydraulic components having an extended life, lesser cost and greater reliability. Further, the injection of chemical into the mixing head by a pair of pumps 10 requires a relatively high degree of precision of the flow volume. The precision is controlled by the amount of hydraulic fluid injected into cylinder 35 and, therefore, chemical which is injected through pumping cylinder 82 due to movement of the piston assembly 60. By providing a 2:1 ratio of diameter of the hydrualic driving piston and the chemical injection piston, a 1% error in the amount of hydraulic fluid flow results in only a ½% of error in chemical volume injected thereby increasing also the accuracy of chemical supplied by the pump 10. Thus, with the system of the present invention, not only is an improved pump provided in terms of access for replacement and repair of the pumping piston, also the pump provides improved performance and greater reliability.

It will become apparent to those skilled in the art that various modifications to the preferred embodiments, as shown herein, can be made without departing from the spirit or scope of the invention as defined by the appended claims.

The embodiments of the invention in which an exclusive property or privilege is claimed are defined as follows:

1. A liquid pump for a chemical injection molding system comprising:

a driving member movable with respect to a support housing;

a chemical injection cylinder including an injection piston;

rod means for coupling said piston and said driving member for synchronous movement, wherein said driving member is capable of moving said rod through a lineal distance sufficient to withdraw said injection piston from said injection cylinder when said piston is fixedly secured thereto;

means for securing said injection piston to said rod means to prevent rotation therebetween; and a cylindrical sleeve for coupling said housing and said injection cylinder in spaced relationship and including at least one access port such that said injection piston can be lineally withdrawn from said injection cylinder into said sleeve for servicing through said access port without disassembly of said pump.

2. The apparatus as defined in claim 1 wherein said cylindrical sleeve includes flange means at opposite ends for coupling said sleeve between said cylinder and said injection cylinder.

3. The apparatus as defined in claim 2 wherein said sleeve includes a plurality of spaced ports extending around the periphery of said sleeve.

4. The apparatus as defined in claim 3 wherein said piston of said driving member has a diameter significantly greater than the diameter of said injection piston.

5. The apparatus as defined in claim 4 wherein said piston has a diameter twice that of said injection piston.

6. A pump with readily accessible seals comprising:

a driving cylinder including a piston;

a pumping cylinder with an open end and including a pumping piston having replaceable seals;

rod means coupling said piston and said pumping piston together for synchronous movement, wherein the stroke of said piston can move said rod lineally through a distance sufficient to withdraw said pumping piston through said open end of said pumping cylinder; and a coupling sleeve for coupling said driving cylinder to said open end of said pumping cylinder and in spaced relationship, said coupling sleeve including access means such that said pumping piston can be withdrawn from said open end of said pumping cylinder without movement of said pumping piston with respect to said rod such that said replaceable seals are located in alignment with said access means of said coupling sleeve for servicing without disassembly of said pump.

7. The apparatus as defined in claim 6 wherein said sleeve includes a plurality of spaced ports extending around the periphery of said sleeve.

8. The apparatus as defined in claim 6 wherein said sleeve includes flange means at opposite ends for coupling said sleeve between said driving cylinder and said pumping cylinder.

* * * * *